US008395471B2

(12) United States Patent
Nakatsuji

(10) Patent No.: US 8,395,471 B2
(45) Date of Patent: Mar. 12, 2013

(54) ELECTRONIC COMPONENT

(75) Inventor: Yoichi Nakatsuji, Kyoto (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/961,044

(22) Filed: Dec. 6, 2010

(65) Prior Publication Data

US 2011/0074537 A1 Mar. 31, 2011

Related U.S. Application Data

(63) Continuation of application No. PCT/JP2009/059116, filed on May 18, 2009.

(30) Foreign Application Priority Data

Jun. 12, 2008 (JP) ..... 2008-153747

(51) Int. Cl.
*H01F 5/00* (2006.01)
*H01F 17/06* (2006.01)
*H01F 27/28* (2006.01)

(52) U.S. Cl. ..... 336/200; 336/223; 336/178

(58) Field of Classification Search ..... 336/200, 336/223, 232, 233, 234, 178
See application file for complete search history.

(56) References Cited

U.S. PATENT DOCUMENTS

| | | | | |
|---|---|---|---|---|
| 5,551,146 | A * | 9/1996 | Kawabata et al. | 29/608 |
| 5,552,756 | A * | 9/1996 | Ushiro | 336/200 |
| 6,181,232 | B1 * | 1/2001 | Kitamura | 336/200 |
| 6,515,568 | B1 * | 2/2003 | Maki et al. | 336/200 |
| 7,304,557 | B2 * | 12/2007 | Tsuzuki et al. | 336/200 |
| 7,375,608 | B2 * | 5/2008 | Suzuki et al. | 336/200 |
| 7,375,609 | B2 * | 5/2008 | Suzuki et al. | 336/200 |
| 7,907,044 | B2 * | 3/2011 | Tada et al. | 336/200 |
| 2001/0052838 | A1 * | 12/2001 | Hamanaka et al. | 336/200 |
| 2006/0214759 | A1 * | 9/2006 | Kawarai | 336/200 |

FOREIGN PATENT DOCUMENTS

| | | | |
|---|---|---|---|
| CN | 1363938 | A | 8/2002 |
| CN | 101090026 | A | 12/2007 |
| JP | 58-184709 | A | 10/1983 |
| JP | 08-088121 | | 4/1996 |
| JP | 09-186017 | | 7/1997 |
| JP | 10-012443 | | 1/1998 |
| JP | 11-097245 | | 4/1999 |
| JP | 2003-086426 | A * | 3/2003 |
| JP | 2005-294602 | A | 10/2005 |
| JP | 2007-214424 | A | 8/2007 |
| JP | 2007-324554 | A | 12/2007 |
| JP | 2007-324555 | A | 12/2007 |
| JP | 2008-78234 | A | 4/2008 |

(Continued)

OTHER PUBLICATIONS

K. Migita; "International Search Report"; PCT/JP2009/059116; Aug. 18, 2009.

(Continued)

*Primary Examiner* — Mohamad Musleh
*Assistant Examiner* — Mangtin Lian
(74) *Attorney, Agent, or Firm* — Studebaker & Brackett PC; Tim L. Brackett, Jr.; John E. Guay

(57) ABSTRACT

An electronic component having a coil includes a laminated body formed by laminating a plurality of magnetic body layers. The coil is formed by connecting coil electrodes in the laminated body. Nonmagnetic body layers are disposed on the laminated body to have a gap with the coil when seen in a plan view from a coil axis direction of the coil. The embodiment of an electronic component has a stair-like direct-current superposition characteristic.

18 Claims, 10 Drawing Sheets

FOREIGN PATENT DOCUMENTS

| | | | |
|---|---|---|---|
| JP | 2008-078243 | A | 4/2008 |
| KR | 10-1999-0034422 | A | 5/1999 |
| WO | 2009/069387 | A1 | 6/2009 |

OTHER PUBLICATIONS

K.Migita; "Written Opinion of the International Searching Authority"; PCT/JP2009/059116; Aug. 18, 2009.

Korean Office Action issued on Oct. 21, 2011; Korean Application No. 2011-7024805; with English Abstract of the Examination result.

The Notice on the First Office Action from the State Intellectual Property Office of the People's Republic of Chine dated Apr. 18, 2012; Chine Patent Application No. 200980122210.5; with translation.

The second Office Action issued by the Korean Intellectual Property Office on May 31, 2012; Korean Patent Application No. 2010-7024805; with English language summary.

* cited by examiner

ELECTRONIC COMPONENT

CROSS REFERENCE TO RELATED APPLICATIONS

The present application claims priority to PCT JP2009/059116 application filed May 18, 2009, and to Japanese Patent Application No. 2008-153747 filed Jun. 12, 2008. The entire contents of these references are incorporated herein by reference in their entirety.

FIELD OF THE INVENTION

The present invention relates to an electronic component, and more specifically to an electronic component including a coil in a laminated body.

BACKGROUND

As a related-art electronic component including a coil, for example, a laminated-type inductance element described in Japanese Unexamined Patent Application Publication No. 2007-214424 is known. The laminated-type inductance element includes a spiral coil made of an internal conductor, a first nonmagnetic body layer disposed perpendicularly to a coil axis of the coil, and a second nonmagnetic body layer disposed in the internal conductor.

With the laminated-type inductance element, the first nonmagnetic body layer is disposed to cross the coil, and thus the coil forms an open magnetic-path structure. As a result, even if a current of the laminated-type inductance element becomes high, a rapid decrease in inductance value due to magnetic saturation is not likely to occur. That is to say, the direct-current superposition characteristic of the laminated inductance element improves.

Incidentally, an electronic component including a coil is sometimes used for a DC-DC converter in an electronic device, such as a mobile telephone, etc. An electronic device, such as a mobile telephone, etc., has a normal state in which normal operation is performed, and a standby state in which many functions are stopped. In the normal state, a relatively high current flows through the coil of the electronic component included in the DC-DC converter (hereinafter referred to as a high-output current area). In the standby state, a weak current flows through the coil of the electronic component included in the DC-DC converter (hereinafter referred to as a low-output current area).

In the electronic component, in the low-output current area, a direct-current superposition characteristic in which a sufficiently large inductance value is obtained is desirable. At the same time, in the electronic component, in the high-output current area, a stable direct-current superposition characteristic in which an inductance value does not change significantly, even if a direct current value flowing through the coil is changed. In this manner, a direct-current superposition characteristic, in which a sufficiently large inductance value is obtained in a low-output current area while a stable inductance value is obtained in a high-output current area, is called a stair-like direct-current superposition characteristic.

However, in the laminated-type inductance element described in Japanese Unexamined Patent Application Publication No. 2007-214424, a stair-like direct-current superposition characteristic cannot be obtained. More specifically, in the laminated-type inductance element, a rapid decrease in inductance value due to magnetic saturation does not occur, and thus the laminated-type inductance element has a direct-current superposition characteristic in which an inductance value monotonously and gradually decreases with an increase in direct current. Accordingly, there has been a problem in that a laminated-type inductance element is difficult to be applied to a DC-DC converter.

SUMMARY

An embodiment of an electronic component consistent with the claimed invention includes a coil having a stair-like direct-current superposition characteristic.

In one aspect of the electronic component, there is provided an electronic component including: a laminated body formed by laminating a plurality of first insulating layers; a coil disposed in the laminated body; and a second insulating layer disposed on the laminated body in at a predetermined distance from the coil, the distance being viewable as a gap between the coil and the second insulating layer when viewed in a plan view from a coil axis direction of the coil, and the second insulating layer having a magnetic permeability lower than that of the first insulating layers.

By the above-mentioned embodiment, it is possible to obtain an electronic component having a stair-like direct-current superposition characteristic.

DETAILED DESCRIPTION

Description of an electronic component 10*a* according to a first embodiment of the present invention with reference to the drawings will be given as follows.

Figure 1:
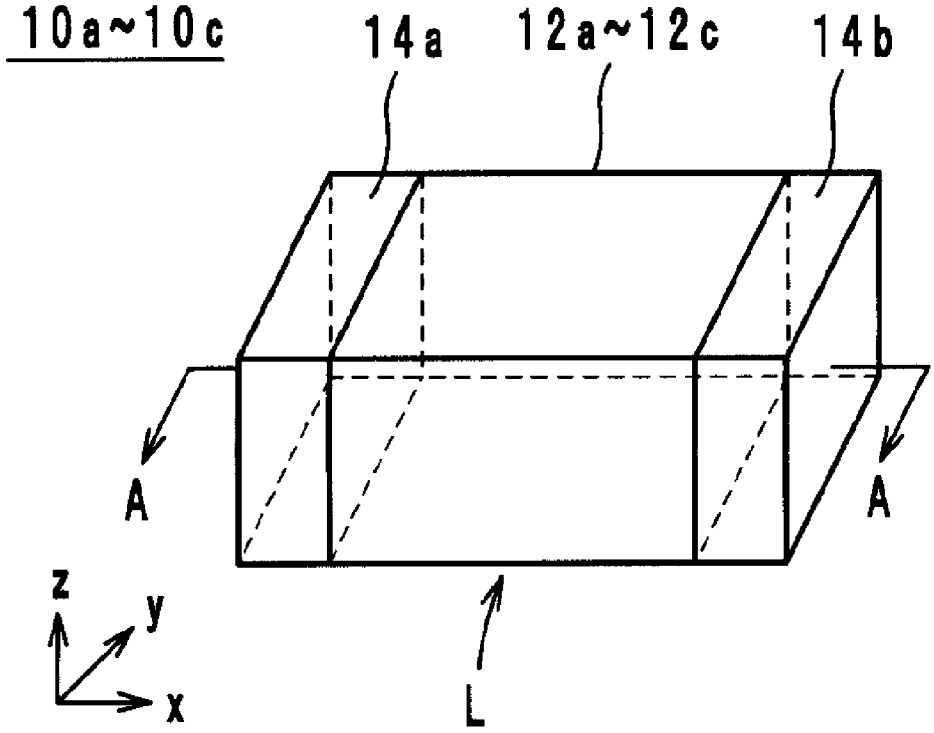
FIG. 1 is a perspective view of an electronic component according to a first embodiment.
Figure 2:
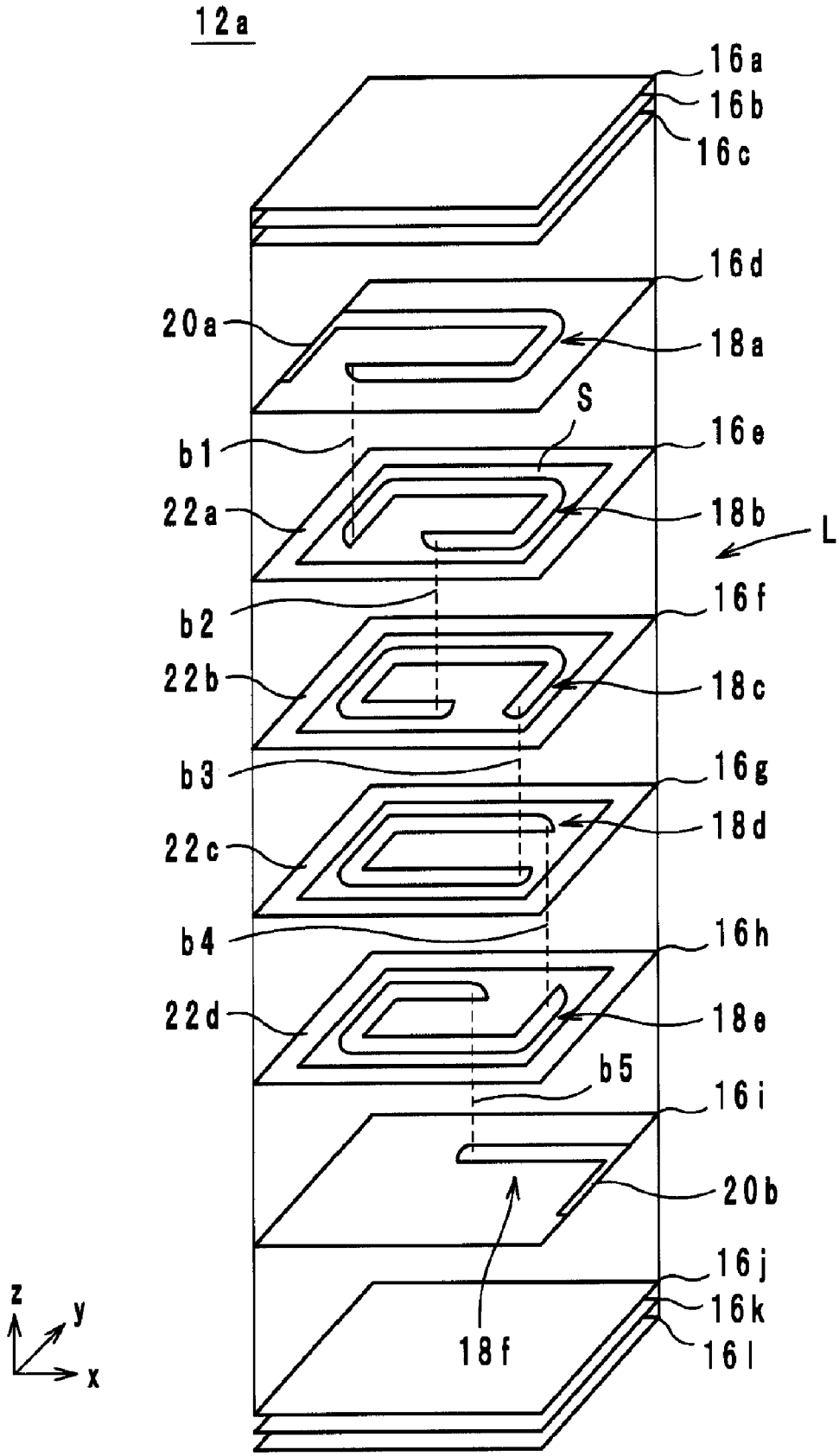
FIG. 2 is an exploded perspective view of a laminated body of the electronic component according to the first embodiment.
Figure 3:
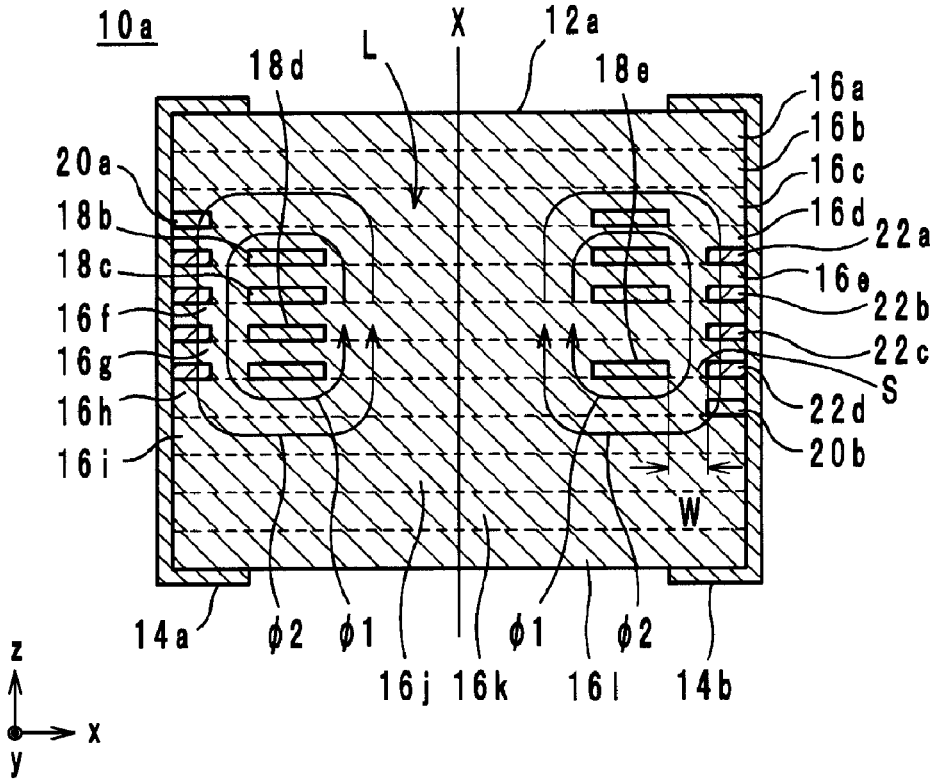
FIG. 3 is a sectional structure view taken on A-A of the electronic component in FIG. 1.

FIG. 1 is a perspective view of the electronic component 10*a* according to the first embodiment. FIG. 2 is an exploded perspective view of a laminated body 12*a* of the electronic components 10*a* according to the first embodiment. FIG. 3 is a sectional structure view taken on A-A of the electronic component 10*a* in FIG. 1.

In describing aspects of the present embodiment, a lamination direction of the electronic components 10*a* is defined as the z-axis direction, a direction along a long side of the electronic component 10*a* is defined as the x-axis direction, and a direction along a short side of the electronic component 10*a* is defined as the y-axis direction. The x-axis, the y-axis, and the z-axis are perpendicular to one another.

As shown in FIG. 1, the electronic component 10*a* includes the laminated body 12*a* and external electrodes 14*a*, 14*b*. The laminated body 12*a* has the shape of a cuboid, and includes a coil L. The external electrodes 14*a*, 14*b* are electrically connected to the coil L (not shown) individually, and are formed to cover side faces positioned at both ends in the x-axis direction.

As shown in FIG. 2, the laminated body 12*a* includes a plurality of rectangular magnetic body layers 16*a* to 16*l* (i.e., insulating layers) that are laminated in sequence from the top in the z-axis direction. The magnetic body layers 16*a* to 16*l* are made of ferromagnetic ferrite (for example, Ni—Zn—Cu ferrite, or Ni—Zn ferrite, etc.). In the embodiment shown in FIG. 2, the magnetic body layers 16*a* to 16*l* are 12 layers of magnetic body layers. However, the total number of the magnetic body layers 16*a* to 16*l* is not limited to 12. In the description of various embodiments, when indicating each of the magnetic body layers 16*a* to 16*l*, an alphabet is added after a reference numeral, and when indicating these generically, an alphabet after a reference numeral is omitted.

As shown in FIG. 2, the coil L is a spiral coil progressing in the z-axis direction with turns. That is, as shown in FIG. 3, a coil axis X of the coil L is parallel to the z-axis direction. As shown in FIG. 2, the coil L includes coil electrodes 18*a* to 18*f*, lead-out sections 20*a*, 20*b*, and via-hole conductors b1 to b5.

As shown in FIG. 2, the coil electrodes 18*a* to 18*f* are formed on main surfaces of the magnetic body layers 16*d* to 16*i*, respectively, and are laminated together with the magnetic body layers 16. Each of the coil electrodes 18*a* to 18*f* is formed by a conductive material made of Ag, has a length of a ⅞ turn, and is disposed to overlap one another in the z-axis direction. Thereby, the coil L constructed by the coil electrodes 18*a* to 18*f* forms a rectangular loop when seen in a plan view from the z-axis direction. The lengths of the coil electrodes 18*a* to 18*f* are not limited to a ⅞ turn.

In describing aspects of the present embodiment, when indicating each of the coil electrodes 18*a* to 18*f*, an alphabet is added after a reference numeral, and when indicating these generically, an alphabet after a reference numeral is omitted.

As shown in FIG. 2, ends of the coil electrodes 18*a* to 18*f* are provided with lead-out sections 20*a*, 20*b*, respectively. The lead-out sections 20*a*, 20*b* are respectively connected to the external electrodes 14*a*, 14*b*. Thereby, the coil L is connected to the external electrodes 14*a*, 14*b*.

As shown in FIG. 2, the via-hole conductors b1 to b5 are formed to pass through the magnetic body layers 16*d* to 16*h*, respectively, in the z-axis direction. The via-hole conductors b1 to b5 function as connecting sections connecting adjacent coil electrodes 18 with each other when the magnetic body layers 16*a* to 16*l* are laminated.

In more detail, the via-hole conductor b1 connects an end of the coil electrode 18*a*, on which the lead-out section 20*a* is not disposed, and an end of the coil electrode 18*b*.

The via-hole conductor b2 connects an end of the coil electrode 18*b*, where the via-hole conductor b1 is not connected, and an end of the coil electrode 18*c*.

The via-hole conductor b3 connects an end of the coil electrode 18*c*, where the via-hole conductor b2 is not connected, and an end of the coil electrode 18*d*.

The via-hole conductor b4 connects an end of the coil electrode 18*d*, where the via-hole conductor b3 is not connected, and an end of the coil electrode 18*e*.

The via-hole conductor b5 connects an end of the coil electrode 18*e*, where the via-hole conductor b4 is not connected, and an end on which the lead-out section 20*b* is not disposed of the ends of the coil electrode 18*f*.

Also, the magnetic body layers 16*e* to 16*h* are provided with nonmagnetic body layers 22*a* to 22*d*, respectively.

As shown in FIG. 2 and FIG. 3, the nonmagnetic body layers 22*a* to 22*d* are insulating layers provided on the laminated body 12*a* and spaced from the coil L thereby forming a gap S between and the nonmagnetic layers 22*a*-22*d* the coil L when seen in a plan view from the coil axis X (shown in FIG. 3) of the coil L, which is parallel the z-axis direction in the present embodiment. In other words, the nonmagnetic body layers are disposed in the laminated body at a distance from the coil, wherein the distance is viewable as a gap between the second insulating layer and the coil when viewed in a plan view from a coil axis direction of the coil. The gap S preferably has a width W of not less than 10 μm and not greater than 150 μm.

As shown in FIG. 2, the nonmagnetic body layers 22*a* to 22*d* are disposed outside the coil electrodes 18*b* to 18*e* on the main surface of the magnetic body layers 16*e* to 16*h* to surround the coil electrodes 18*b* to 18*e*. However, the nonmagnetic body layers 22*a* to 22*d* are not necessarily formed to be a loop to surround the coil electrodes 18*b* to 18*e*, and may be formed on a part of the outside of the coil electrodes 18*b* to 18*e*.

In describing aspects of the present embodiment, when indicating each of the nonmagnetic body layers 22*a* to 22*d*, an alphabet is added after a reference numeral, and when indicating these generically, an alphabet after a reference numeral is omitted.

By the electronic component 10*a* having the above-described configuration, the nonmagnetic body layers 22 are disposed spaced apart from the coil L thus leaving the gap S between the nonmagnetic body layers 22 and the coil L when seen in a plan view from the coil axis X (i.e., the z-axis direction). Thus, it is possible to obtain a stair-like direct-current superposition characteristic as described below.

As shown in FIG. 3, magnetic flux that occurs by the coil L includes magnetic flux $\phi$1 and $\phi$2 going around the coil electrodes 18*a* to 18*f* arranged in the z-axis direction. In the electronic component 10*a*, the gap S is disposed between the nonmagnetic body layers 22 and the coil L so that the magnetic flux $\phi$1 passes through the gap S between the nonmagnetic body layers 22 and the coil L around the coil electrodes 18*a* to 18*f*. That is, the magnetic flux $\phi$1 forms a closed magnetic path. On the other hand, the magnetic flux $\phi$2 goes around in a wider circle to pass through the nonmagnetic body layers 22 around the coil electrodes 18*a* to 18*f*. That is to say, the magnetic flux $\phi$2 forms an open magnetic path.

In the sectional structure of the electronic component 10*a* shown in FIG. 3, the coil electrodes 18*a* to 18*f* are arranged in two columns at the right and left, sandwiching the coil axis X, and thus the magnetic flux $\phi$1, $\phi$2 occurs at the individual columns of the coil electrodes 18*a* to 18*f*, respectively.

First, when a direct current flowing through the coil L is weak, magnetic saturation does not occur in both areas through which the magnetic flux $\phi$1, $\phi$2 passes. Further, the magnetic flux $\phi$1 forms a closed magnetic path, and thus the inductance value of the coil L is sufficiently large.

Next, if a direct current flowing through the coil L is gradually increased, magnetic saturation occurs in the area through which the magnetic flux ϕ1, which is a closed magnetic path, passes. However, since the magnetic flux ϕ2 is an open magnetic path, immediately after magnetic saturation occurs in the area through which the magnetic flux ϕ1 is passing, magnetic saturation does not occur in the area through which the magnetic flux ϕ2 is passing. Accordingly, in the coil L, only the inductance value derived from the magnetic flux ϕ1 rapidly decreases. At the same time, in the coil L, the inductance value derived from the magnetic flux ϕ2 is maintained without decreasing greatly.

Next, if a current value of a direct current flowing through the coil L is further increased, until magnetic saturation occurs in the area through which the magnetic flux ϕ2 is passing, the inductance value of the coil L is maintained without decreasing greatly. Consequently, if the current value of the direct current flowing through the coil L is further increased, magnetic saturation also occurs in the area through which the magnetic flux ϕ2 is passing, and the inductance value of the coil L rapidly decreases again. Thus, by the electronic component 10*a*, it is possible to obtain a stair-like direct-current superposition characteristic.

Figure 4:
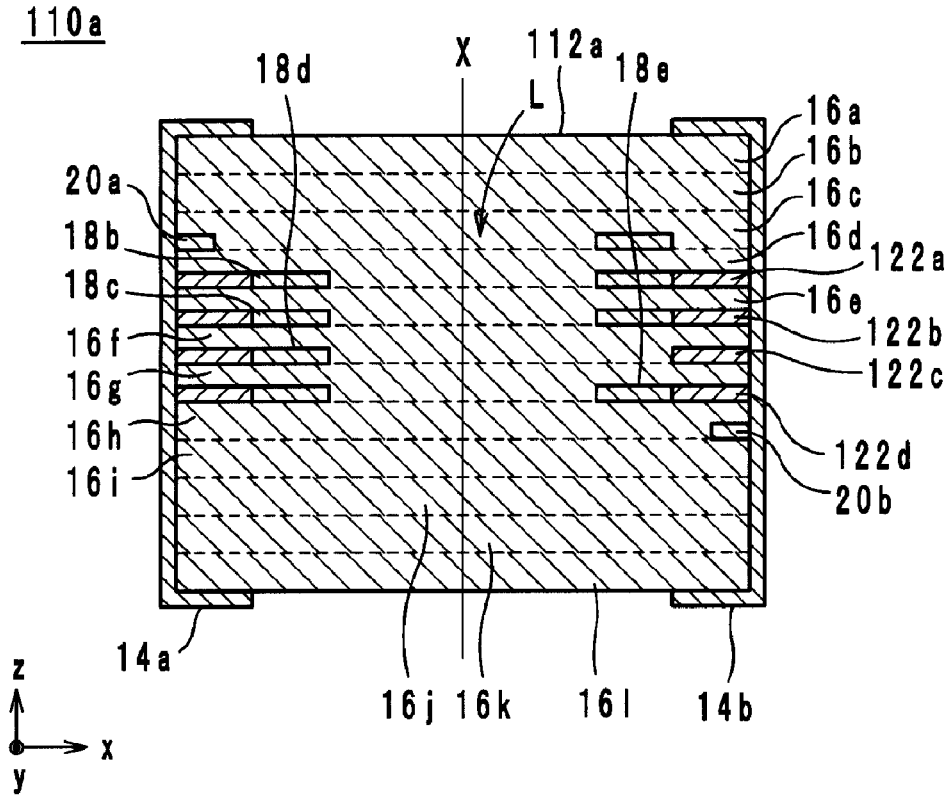
FIG. 4 is a sectional structure view of an electronic component according to a comparative example.

The inventor of the present invention made an analysis described below by using computer simulation in order to clarify the advantages obtained by the electronic component 10*a*. More specifically, the inventor made a first model corresponding to the electronic component 10*a* according to the present embodiment shown in FIG. 3, and calculated the direct-current superposition characteristic of the first model. Also, the inventor made a second model corresponding to the electronic component 110*a* according to a comparative example shown by a sectional view in FIG. 4, and calculated the direct-current superposition characteristic of the second model. The electronic component 10*a* and the electronic component 110*a* are different in that the electronic component 10*a* is provided with the gap S between the coil electrodes 18 and the nonmagnetic body layers 22, whereas the electronic component 110*a* is not provided with the gap S between the coil electrodes 18 and the nonmagnetic body layers 122.

Further, the inventor designed such that both initial values of the inductance values of the first model and the second model match each other. However, if the coil L of the first model and the coil L of the second model have the same configuration, the initial value of the inductance value of the first model becomes higher than the initial value of the inductance value of the second model. That is, the first model has a higher inductance value than the second model at a very little direct current.

Figure 5:
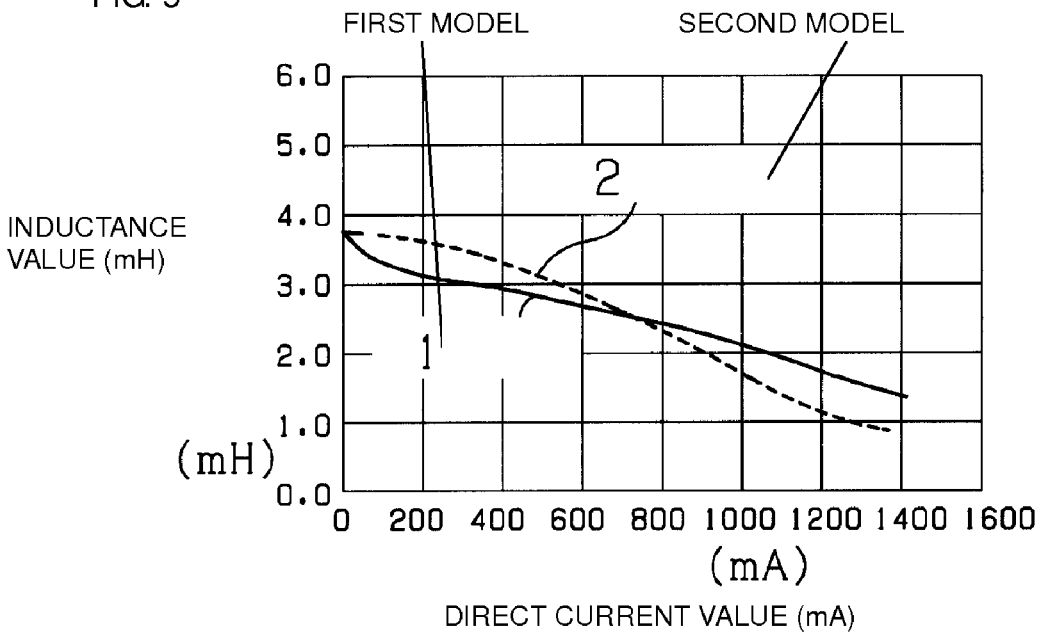
FIG. 5 is a graph illustrating an analysis result.

FIG. 5 is a graph illustrating the analysis result. The vertical axis shows inductance value, and the horizontal axis shows direct current value. As shown in FIG. 5, it is understood that in the direct-current superposition characteristic of the second model, the inductance value decreases monotonously as the direct current value increases, whereas the direct-current superposition characteristic of the first model is stair-like. Specifically, in the second model, the direct-current superposition characteristic in which the inductance value decreases gradually as the direct-current value increases is obtained. On the other hand, in the first model, when a little direct current flows, the inductance value decreases, and then the inductance value is maintained without decreasing greatly.

By the above-described embodiment of the electronic component 10*a*, in an area in which the direct current flowing through the coil L is very small, the direct-current superposition characteristic allowing a sufficiently large inductance value is obtained. Moreover, in an area in which the direct current flowing through the coil L is great, the direct-current superposition characteristic, in which the inductance value hardly changes when the direct current changes, is obtained. As a result, it is possible to apply the electronic component 10*a* to a DC-DC converter.

In the following, a description will be given of a method of manufacturing the electronic component 10*a* with reference to the drawings.

Ceramic green sheets to be the magnetic body layers 16*a* to 16*l* are produced by the following process. Ferric oxide ($Fe_2O_3$), zinc oxide (ZnO), nickel oxide (NiO), and copper oxide (CuO) are weighed at a predetermined amount, the individual materials are put into a ball mill as raw materials, and are subjected to wet mixing. The obtained mixture is dried and then crushed, and the obtained powder is calcined at 750° C. for one hour. The obtained calcined powder is subjected to wet crushing by a ball mill, and is then dried and disintegrated to obtain ferromagnetic ferrite ceramic powder.

Binder (e.g., vinyl acetate, water-soluble acryl, etc.), plasticizer, humectant, and dispersant are added to the ferrite ceramic powder. The powder is subjected to mixing by a ball mill. The mixed powder is then subjected to defoaming by decompression. The obtained ceramic slurry is formed into a sheet state by the doctor blade method, and is then dried. Thus, ceramic green sheets to be the magnetic body layers 16*a* to 16*l* are produced.

Next, the via-hole conductors b1 to b5 are formed on the ceramic green sheets to be the magnetic body layers 16*d* to 16*h*, respectively. Specifically, as shown in FIG. 2, laser beams are irradiated on the ceramic green sheets to be the magnetic body layers 16*d* to 16*h* to form the via-holes. Next, conductive paste of, such as Ag, Pd, Cu, Au, and the alloys thereof, etc., is filled in the via-holes by a method, such as printing application.

Next, conductive paste having Ag, Pd, Cu, Au, and the alloys thereof, etc., as a main component is applied on the ceramic green sheets to be the magnetic body layers 16*d* to 16*i* by a method, such as a screen-printing method, a photolithography method, etc., to form the coil electrodes 18*a* to 18*f* and the lead-out sections 20*a*, 20*b*. A conductive paste may be filled in the via-hole conductors at the same time as formation of the coil electrodes 18*a* to 18*f* and the lead-out sections 20*a*, 20*b*.

Next, by a process described below, layers to be the nonmagnetic body layers 22*a* to 22*d* are formed on the ceramic green sheets to be 16*e* to 16*h*.

Ferric oxide ($Fe_2O_3$), zinc oxide (ZnO), and copper oxide (CuO) are weighed at a predetermined amount. The materials are put into a ball mill as raw materials, and are subjected to wet mixing. The obtained mixture is dried and then crushed, and the obtained powder is calcined at 750° C. for one hour. The obtained calcined powder is subjected to wet crushing by a ball mill, and is then dried and disintegrated to obtain nonmagnetic ferrite ceramic powder.

Binder (e.g., vinyl acetate, water-soluble acryl, etc.), plasticizer, humectant, and dispersant are added to the ferrite ceramic powder. The powder is subjected to mixing by a ball mill and then to defoaming by decompression. The obtained ceramic slurry is applied on the magnetic body layers 16*e* to 16*h* by screen printing. Subsequently, by drying the ceramic slurry, as shown in FIG. 2, the layers to be the nonmagnetic body layers 22*a* to 22*d* are formed on the ceramic green sheets to be the magnetic body layers 16*e* to 16*h*.

Next, as shown in FIG. 2, the ceramic green sheets to be the magnetic body layers 16*a* to 16*l* are laminated to be arranged in an order from the upper side to the lower side. More specifically, the ceramic green sheet to be the magnetic body layer 16*l* is disposed. Next, the ceramic green sheet to be the magnetic body layer 16*k* is disposed and tentatively pressure-contacted on the ceramic green sheet to be the magnetic body layer 16*l*. Thereafter, in the same manner, the ceramic green sheets to be the magnetic body layers 16*j*, 16*i*, 16*h*, 16*g*, 16*f*, 16*e*, 16*d*, 16*c*, 16*b*, and 16*a* are laminated in this order, and are pressure-contacted to obtain a mother (i.e., bulk) laminated body. Further, the mother laminated body is subjected to permanent pressure-contacting by hydrostatic pressing, etc.

Next, the mother laminated body is cut into the laminated body 12*a* having a predetermined dimensions by guillotine cut to obtain unfired laminated body 12*a*. This laminated body 12*a* is then subjected to binder burnout processing and firing. The binder burnout processing is performed, for example at 500° C. for two hours in a low oxygen atmosphere. The firing is carried out, for example on the condition of 1000° C. for two hours.

By the above process, the fired laminated body 12*a* is obtained. The laminated body 12*a* is subjected to barrel finishing and chamfering. Subsequently, an electrode paste including silver as a main component is applied and baked on the surface of the laminated body 12*a*, for example by a dipping method, etc., and silver electrodes to be the external electrodes 14*a*, 14*b* are formed. The silver electrodes are dried at 120° C. for 10 minutes, and baking of the silver electrodes is conducted at 890° C. for 60 minutes. Finally, Ni plating/Sn plating is applied on the surface of the silver electrodes so that the external electrodes 14*a*, 14*b* are formed. By going through the above process, the electronic component 10*a* as shown in FIG. 1 is completed.

Figure 6:
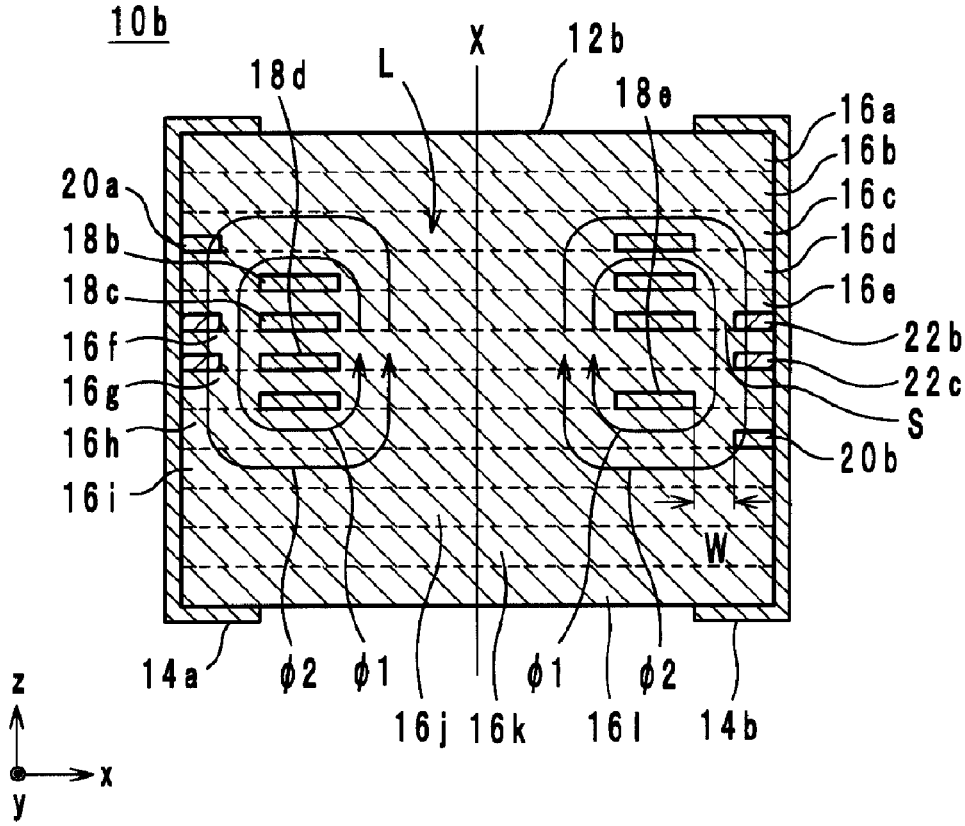
FIG. 6 is a sectional structure view of an electronic component according to a first variation of the electronic component according to the first embodiment.

The following description of an electronic component 10*b* according to a first variation of the electronic component 10*a* will be given. FIG. 6 is a sectional structure view of the electronic component 10*b* according to the first variation. FIG. 1 provides an outer perspective view of the electronic component 10*b* shown in FIG. 6.

In the electronic component 10*a*, four pieces of nonmagnetic body layers, the nonmagnetic body layers 22*a* to 22*d*, are disposed, but the number of the nonmagnetic body layers is not limited to four. With respect to the electronic component 10*b* shown in FIG. 6, two pieces of nonmagnetic body layers 22*b*, 22*c* may be disposed. As is understood from an analysis result described below, in the electronic component 10*b* shown in FIG. 6, it is possible to obtain a stair-like direct-current superposition characteristic.

Figure 7:
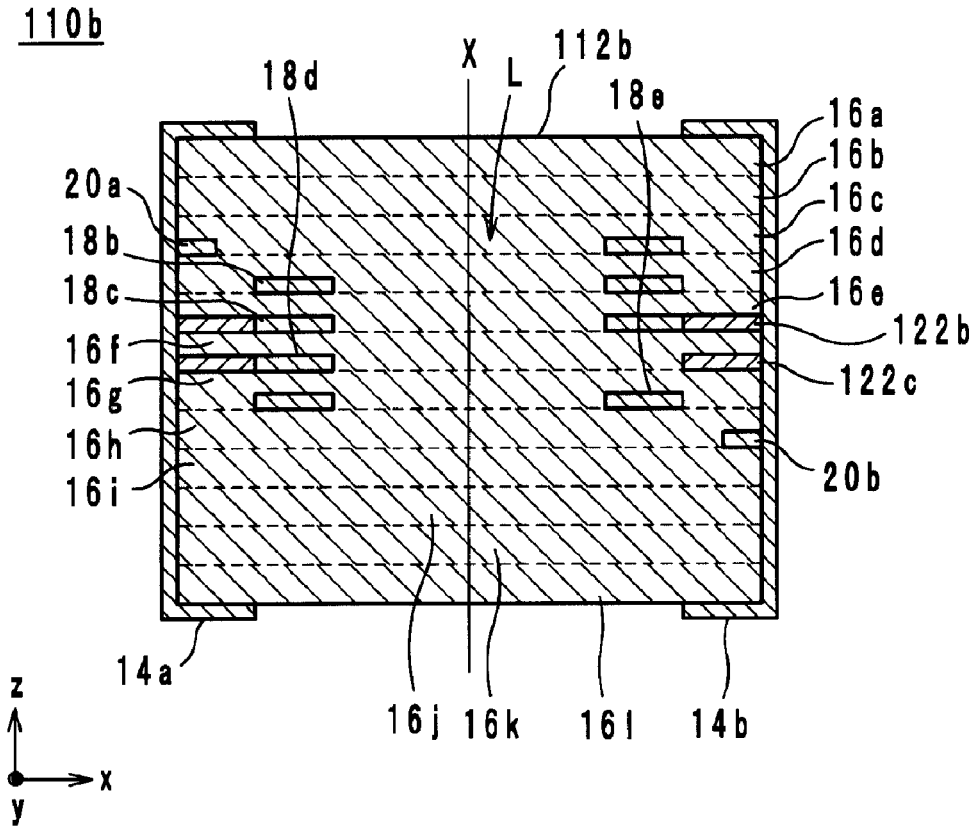
FIG. 7 is a sectional structure view of an electronic component according to a comparative example.

In this analysis, the inventor made a third model corresponding to the electronic component 10*b* according to the present embodiment shown in FIG. 6, and calculated the direct-current superposition characteristic of the third model. The inventor also made a fourth model corresponding to an electronic component 110*b* according to the comparative example shown by a sectional view in FIG. 7 and calculated the direct-current superposition characteristic of the fourth model. The electronic component 10*b* and the electronic component 110*b* are different in that the electronic component 10*b* is provided with the gap S between the coil electrode 18 and the nonmagnetic body layers 22, whereas the electronic component 110*b* is not provided with the gap S between the coil electrode 18 and the nonmagnetic body layers 122. The inventor also designed such that both initial values of the inductance values of the third model and the fourth model match each other.

Figure 8:
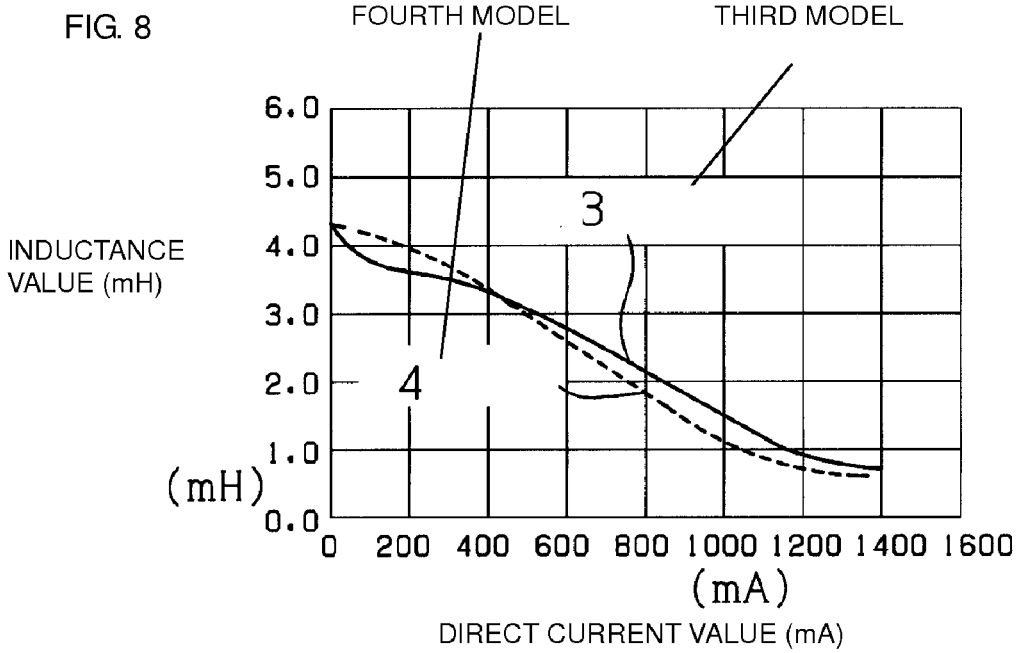
FIG. 8 is a graph illustrating an analysis result.

FIG. 8 is a graph illustrating the analysis result. The vertical axis shows inductance value, and the horizontal axis shows direct current value. As shown in FIG. 8, it is understood that in the direct-current superposition characteristic of the fourth model, the inductance value decreases monotonously as the direct current value increases, whereas the direct-current superposition characteristic of the third model is stair-like.

Figure 9:
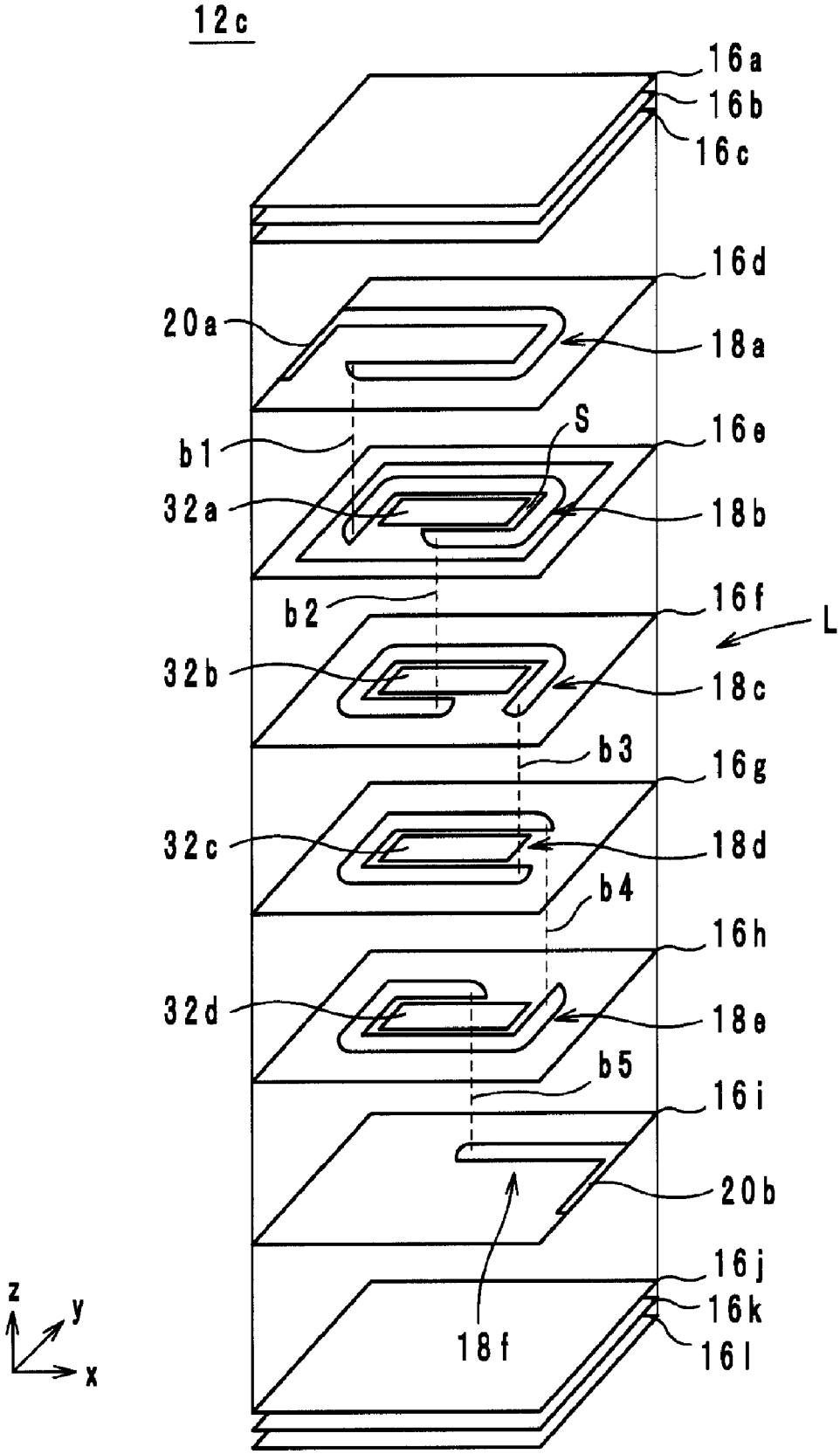
FIG. 9 is an exploded perspective view of a laminated body of an electronic component according to a second variation of the electronic component according to the first embodiment.

Next, description of an electronic component 10*c* according to a second variation of the electronic component 10*a* will be given with reference to the drawings. FIG. 9 is an exploded perspective view of a laminated body 12*c* of the electronic components 10*c* according to the second variation. FIG. 1 provides an outer perspective view of the electronic component 12*c* shown in FIG. 9.

In the electronic component 10*a*, the nonmagnetic body layers 22*a* to 22*d* are disposed outside the coil L when seen in a plan view from a direction of the coil-axis X. However, the position where the nonmagnetic body layers 22*a* to 22*d* are disposed is not limited to this configuration. As shown in FIG. 9, the nonmagnetic body layers 32*a* to 32*d* may be disposed inside the coil L when seen in a plan view from the coil-axis X (i.e. the z-axis direction).

In more detail, the nonmagnetic body layers 32*a* to 32*d* are respectively formed on the magnetic body layers 16*e* to 16*h* in an area surrounded by the coil electrodes 18*b* to 18*e*. There is a gap S between the respective nonmagnetic body layers 32*a* to 32*d* and the coil electrodes 18*b* to 18*e*. In the electronic component 10*c* having the above-described configuration, it is possible to obtain a stair-like direct-current superposition characteristic in the same manner as the electronic component 10*a*.

In this regard, in the electronic components 10*a* to 10*c*, the nonmagnetic body layers 22*a* to 22*d*, 32*a* to 32*d* are disposed. However, alternatively, in place of the nonmagnetic body layers 22*a* to 22*d*, 32*a* to 32*d*, a magnetic body layer, for example, having a lower magnetic permeability than the magnetic body layers 16 may be disposed.

Figure 10:
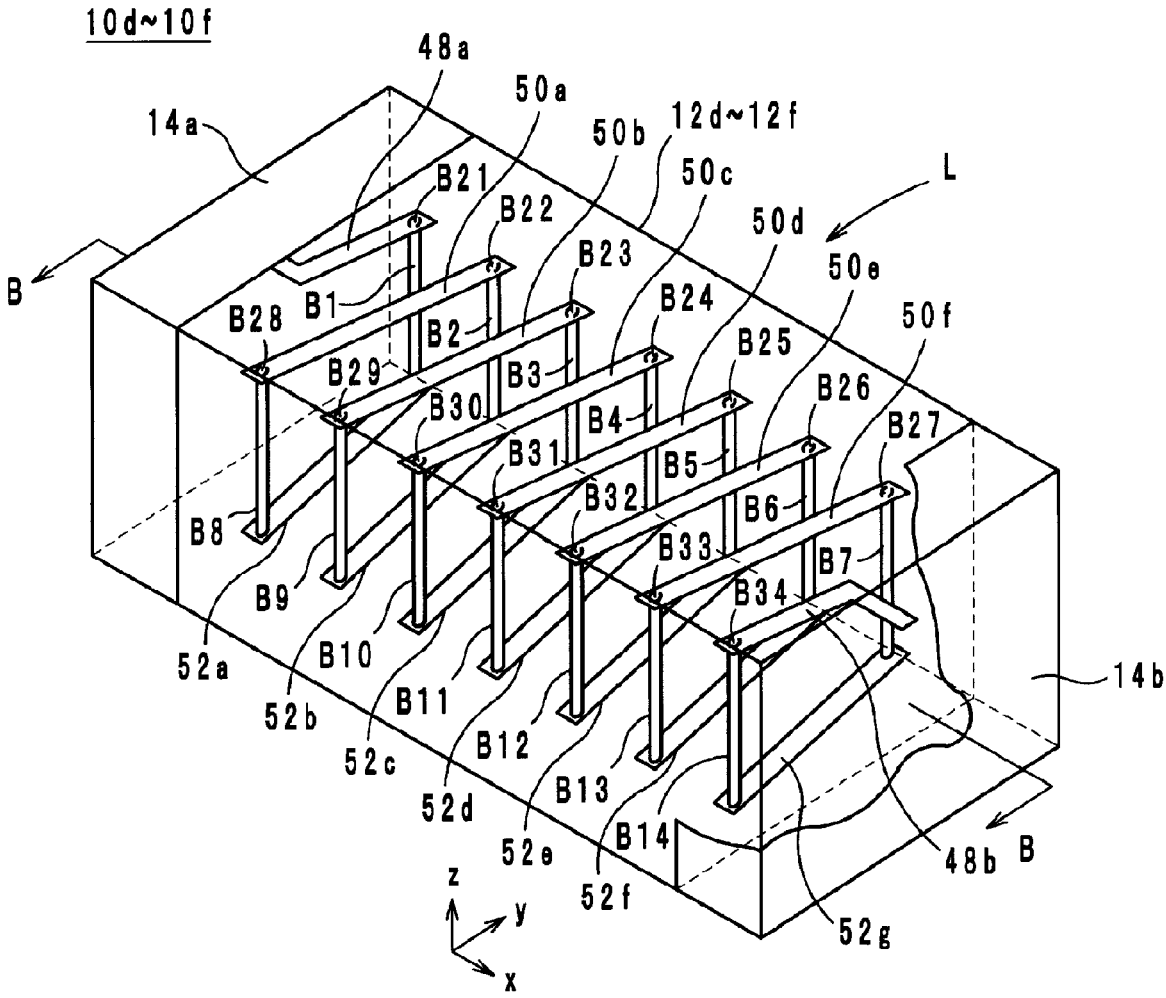
FIG. 10 is a perspective view of an electronic component according to a second embodiment.
Figure 11:
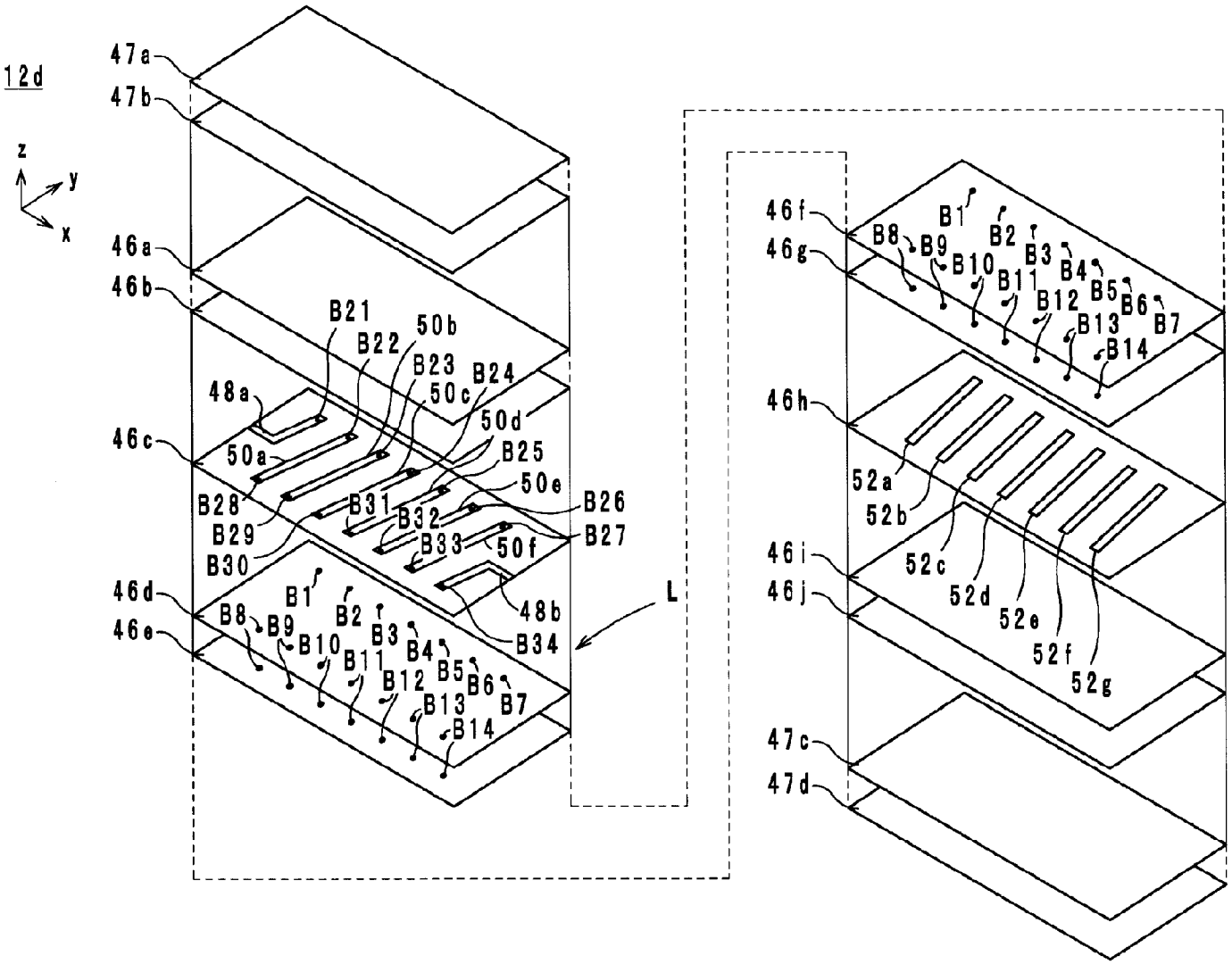
FIG. 11 is an exploded perspective view of a laminated body of the electronic component according to the second embodiment.
Figure 12:
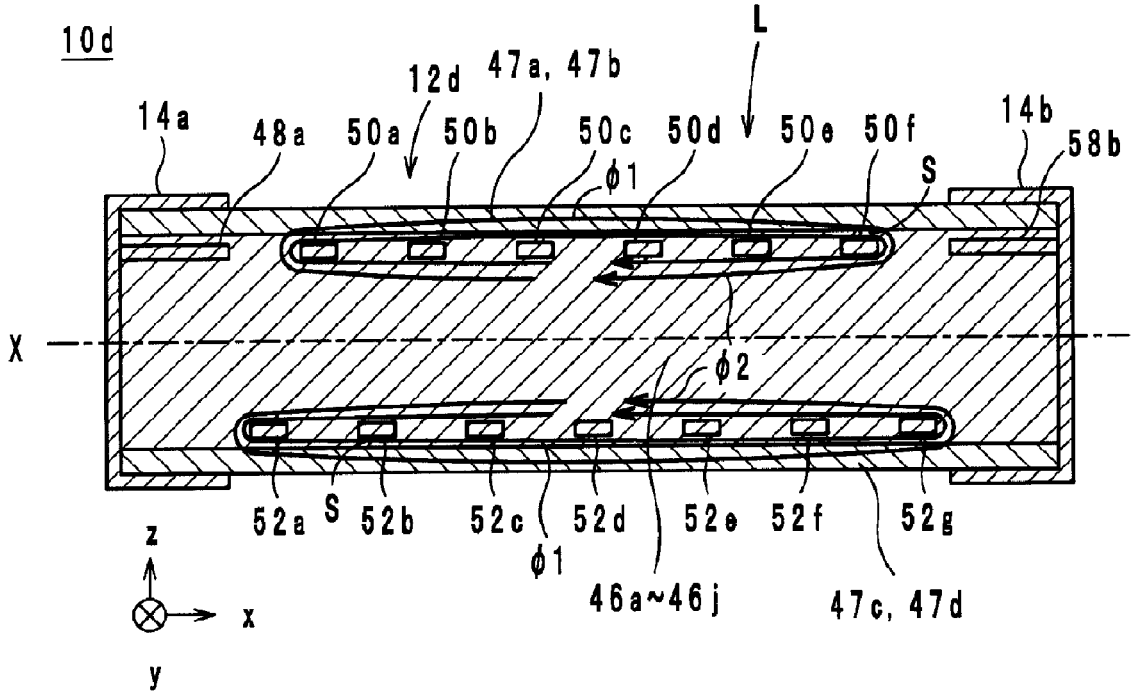
FIG. 12 is a sectional structure view taken on B-B of the electronic component in FIG. 10.

The description of an electronic component 10*d* according to a second embodiment of the present invention with reference to the drawings will now be given. FIG. 10 is a perspective view of the electronic component 10*d* according to the second embodiment. FIG. 11 is an exploded perspective view of a laminated body 12*d* of the electronic components 10*d* according to the second embodiment. FIG. 12 is a sectional structure view taken on B-B of the electronic component 10*d* in FIG. 10.

In describing aspects of the present embodiment, a lamination direction of the electronic components 10*d* is defined as a z-axis direction, a direction along a long side of the electronic component 10*d* is defined as an x-axis direction, and a direction along a short side of the electronic component 10*d* is defined as an y-axis direction. The x-axis, the y-axis, and the z-axis are perpendicular to one another. In FIG. 10, for easy understanding of an internal state, a part of an external electrode 14*b* is cut in the illustration. Also, same reference numerals are given to same components as those of the electronic component 10*a*.

As shown in FIG. 10, the electronic component 10*d* includes the laminated body 12*d* and external electrodes 14*a*, 14*b*. The laminated body 12*d* has the shape of a cuboid, and includes a coil L. The external electrodes 14*a*, 14*b* are electrically connected to the coil L individually, and are formed to cover side faces positioned at both ends in the x-axis direction.

As shown in FIG. 11, the laminated body 12*d* includes a plurality of rectangular magnetic body layers 47*a*, 47*b*, 46*a* to 46*j*, 47*c*, 47*d*, which are insulating layers that are laminated in sequence from the top in the z-axis direction. The magnetic body layers 47*a*, 47*b*, 46*a* to 46*j*, 47*c*, 47*d* are made of ferromagnetic ferrite (for example, Ni—Zn—Cu ferrite, or Ni—Zn ferrite, etc.). However, the magnetic permeability of the 46*a* to 46*j* is higher than the magnetic permeability of the 47*a* to 47*d*. Accordingly, the Ni content by percentage of the magnetic body layers 46*a* to 46*j* is higher than the Ni content by percentage of the magnetic body layers 47*a* to 47*d*. Also, the magnetic body layers 47*a* to 47*d* have the same shape (e.g., rectangular shape) as the magnetic body layers 46*a* to 46*j*.

In the embodiment shown in FIG. 11, the magnetic body layers 46*a* to 46*j* are 10 layers of magnetic body layers. However, the total number of the magnetic body layers 46*a* to 46*j* is not limited to 10. In the electronic component 10*d*, an additional magnetic body layer may be inserted between the magnetic body layer 46*e* and the magnetic body layer 46*f*. Thus, a connection between the magnetic body layer 46*e* and the magnetic body layer 46*f* is denoted by broken lines.

In describing aspects of the present embodiment, when indicating each of the magnetic body layers 46*a* to 46*j*, 47*a* to 47*d*, an alphabet is added after a reference numeral, and when indicating these generically, an alphabet after a reference numeral is omitted.

As shown in FIG. 10, the coil L is a spiral coil progressing in the x-axis direction with turns. That is, as shown in FIG. 11, a coil axis of the coil L is parallel to the x-axis direction. As shown in FIG. 11, the coil L includes lead-out electrodes 48*a*, 48*b*, a plurality of strip electrodes 50*a* to 50*f*, 52*a* to 52*g*, and a plurality of via-hole conductors B1 to B14, B21 to B34.

As shown in FIG. 11, the lead-out electrodes 48*a*, 48*b*, and the strip electrodes 50*a* to 50*f* are formed on the magnetic body layer 46*c* positioned at the relatively upper side in the z-axis direction. The strip electrodes 50*a* to 50*f* shown in FIG. 11 are formed to slope to have a positive gradient in the xy plane when seen in a plan view from the upper side in the z-axis direction, and to be parallel to one another at regular intervals. However, the strip electrodes 50*a* to 50*f* are not necessarily parallel.

As shown in FIG. 11, the lead-out electrode 48*a* has substantially the shape of the letter L. More specifically, the lead-out electrode 48*a* has a shape which extends in parallel with the strip electrodes 50*a* to 50*f* from the back side in the y-axis direction, and is bent approximately in the middle and led out to the left-side edge in the x-axis direction. In the same manner, the lead-out section 48*b* has substantially the shape of the letter L. More specifically, the lead-out section 48*b* has a shape which extends in parallel with the strip electrodes 50 from the front side in the y-axis direction, and is bent in approximately the middle and led out to the right-side edge in the x-axis direction. The lead-out electrodes 48*a*, 48*b* are connected to the external electrodes 14*a*, 14*b*, respectively.

The lead-out electrodes 48*a*, 48*b*, and the strip electrodes 50*a* to 50*f* are formed on the magnetic body layer 46*c* so that the magnetic body layers 47*a*, 47*b* are positioned at the upper side in the z-axis direction of the magnetic body layer 46*c* on which the lead-out electrodes 48*a*, 48*b*, and the strip electrodes 50*a* to 50*f* are formed.

Further, the magnetic body layers 46*a*, 46*b* are positioned between the magnetic body layer 47*b*, and the lead-out electrodes 48*a*, 48*b*, and the strip electrodes 50*a* to 50*f*. Accordingly, as shown in FIG. 12, in the electronic component 10*d*, when seen in a plan view from a direction of the coil-axis X, a gap S is formed between the upper side in the z-axis direction of the coil L and the magnetic body layer 47*b*.

As shown in FIG. 10 and FIG. 11, the strip electrodes 52*a* to 52*g* are formed on the magnetic body layer 46*h* positioned at the relatively lower side in the z-axis direction. The strip electrodes 52*a* to 52*g* are formed to slope to have a negative gradient in the xy plane when seen in a plan view from the upper side in the z-axis direction, and to be parallel to one another at regular intervals.

The strip electrodes 52*a* to 52*g* are formed on the magnetic body layer 46*h* so that the magnetic body layers 47*c*, 47*d* are positioned at the lower side in the z-axis direction of the magnetic body layer 46*h* on which the strip electrodes 52*a* to 52*g* are formed. Further, the magnetic body layers 46*h* to 46*j* are positioned between the magnetic body layer 47*c* and the strip electrodes 52*a* to 52*g*. Accordingly, as shown in FIG. 12, in the electronic component 10*d*, when seen in a plan view from a direction of the coil-axis X, a gap S is formed between the lower side in the z-axis direction of the coil L and the magnetic body layer 47*c*. In this regard, the strip electrodes 52*a* to 52*g* are not necessarily parallel.

As shown in FIG. 11, the via-hole conductors B21 to B27 are connected to the back-side end in the y-axis direction of the lead-out electrode 48*a* and the strip electrodes 50*a* to 50*f*, respectively, and are formed to pass through the magnetic body layer 46*c* in the z-axis direction.

The via-hole conductors B28 to B34 are connected to the front-side end in the y-axis direction of the lead-out sections 48*b* and the strip electrodes 50*a* to 50*f*, respectively, and are formed to pass through the magnetic body layer 46*c* in the z-axis direction.

The via-hole conductors B1 to B7 are formed on the magnetic body layers 46*d* to 46*g*, respectively, at a position matched with the via-hole conductors B21 to B27 when seen in a plan view from the z-axis direction, and are formed to pass through the magnetic body layers 46*d* to 46*g* in the z-axis direction.

Further, via-hole conductors B8 to B14 are formed on the magnetic body layers 46*d* to 46*g*, respectively, at a position matched with the via-hole conductors B28 to B34 when seen in a plan view from the z-axis direction, and are formed to pass through the magnetic body layers 46*d* to 46*g* in the z-axis direction.

The magnetic body layers 47*a*, 47*b*, 46*a* to 46*j*, 47*c*, 47*d* having the above-described configuration are laminated to be arranged in this order so that, as shown in FIG. 12, a spiral coil L progressing in the x-axis direction while turning in the laminated body 12*d* is formed. In more detail, the via-hole conductor B1 and the via-hole conductor B21 are connected to each other to extend in the z-axis direction, and function as connecting sections connecting the back-side end in the y-axis direction of the lead-out electrode 48*a* and the back-side end in the y-axis direction of the strip electrode 52*a*.

The via-hole conductor B2 and the via-hole conductor B22 are connected to each other to extend in the z-axis direction, and function as connecting sections connecting the back-side end in the y-axis direction of the strip electrode 50*a* and the back-side end in the y-axis direction of the strip electrode 52*b*.

The via-hole conductor B3 and the via-hole conductor B23 are connected to each other to extend in the z-axis direction, and function as connecting sections connecting the back-side end in the y-axis direction of the strip electrode 50*b* and the back-side end in the y-axis direction of the strip electrode 52*c*.

The via-hole conductor B4 and the via-hole conductor B24 are connected to each other to extend in the z-axis direction, and function as connecting sections connecting the back-side end in the y-axis direction of the strip electrode 50*c* and the back-side end in the y-axis direction of the strip electrode 52*d*.

The via-hole conductor B5 and the via-hole conductor B25 are connected to each other to extend in the z-axis direction, and function as connecting sections connecting the back-side end in the y-axis direction of the strip electrode 50*d* and the back-side end in the y-axis direction of the strip electrode 52*e*.

The via-hole conductor B6 and the via-hole conductor B26 are connected to each other to extend in the z-axis direction, and function as connecting sections connecting the back-side end in the y-axis direction of the strip electrode 50*e* and the back-side end in the y-axis direction of the strip electrode 52*f*.

The via-hole conductor B7 and the via-hole conductor B27 are connected to each other to extend in the z-axis direction, and function as connecting sections connecting the back-side end in the y-axis direction of the strip electrode 50*f* and the back-side end in the y-axis direction of the strip electrode 52*g*.

Also, the via-hole conductor B8 and the via-hole conductor B28 are connected to each other to extend in the z-axis direction, and function as connecting sections connecting the front-side end in the y-axis direction of the strip electrode 50*a* and the front-side end in the y-axis direction of the strip electrode 52*a*.

The via-hole conductor B9 and the via-hole conductor B29 are connected to each other to extend in the z-axis direction, and function as connecting sections connecting the front-side end in the y-axis direction of the strip electrode 50*b* and the front-side end in the y-axis direction of the strip electrode 52*b*.

The via-hole conductor B10 and the via-hole conductor B30 are connected to each other to extend in the z-axis direction, and function as connecting sections connecting the front-side end in the y-axis direction of the strip electrode 50*c* and the front-side end in the y-axis direction of the strip electrode 52*c*.

The via-hole conductor B11 and the via-hole conductor B31 are connected to each other to extend in the z-axis direction, and function as connecting sections connecting the front-side end in the y-axis direction of the strip electrode 50*d* and the front-side end in the y-axis direction of the strip electrode 52*d*.

The via-hole conductor B12 and the via-hole conductor B32 are connected to each other to extend in the z-axis direction, and function as connecting sections connecting the front-side end in the y-axis direction of the strip electrode 50*e* and the front-side end in the y-axis direction of the strip electrode 52*e*.

The via-hole conductor B13 and the via-hole conductor B33 are connected to each other to extend in the z-axis direction, and function as connecting sections connecting the front-side end in the y-axis direction of the strip electrode 50*f* and the front-side end in the y-axis direction of the strip electrode 52*f*.

The via-hole conductor B14 and the via-hole conductor B34 are connected to each other to extend in the z-axis direction, and function as connecting sections connecting the front-side end in the y-axis direction of the lead-out section 48*b* and the front-side end in the y-axis direction of the strip electrode 52*g*.

By the electronic component 10*d* having the above-described configuration, as shown in FIG. 12, the magnetic body layer 47 having a lower magnetic permeability than the magnetic body layer 46 is disposed to leave the gap S with the coil L when seen in a plan view from a direction of the coil axis X. Accordingly, in the same manner as the electronic component 10*a*, it is possible to obtain a stair-like direct-current superposition characteristic.

The following description of a method of manufacturing the electronic component 10*d* with reference to the drawings will be given.

Ceramic green sheets to be the magnetic body layers 46*a* to 46*j* are produced by the following process. Ferric oxide ($Fe_2O_3$), zinc oxide (ZnO), nickel oxide (NiO), and copper oxide (CuO) are weighed at a predetermined amount, the individual materials are put into a ball mill as raw materials, and are subjected to wet mixing. The obtained mixture is dried and then crushed in to powder. The obtained powder is calcined at 750° C. for one hour. The obtained calcined powder is subjected to wet crushing by a ball mill, and is then dried and disintegrated to obtain ferromagnetic ferrite ceramic powder.

Binder (e.g., vinyl acetate, water-soluble acryl, etc.), plasticizer, humectant, and dispersant are added to the ferrite ceramic powder. The powder is subjected to mixing by a ball mill, and then to defoaming by decompression. The obtained ceramic slurry is formed into a sheet state by the doctor blade method, is dried, and ceramic green sheets to be the magnetic body layers 46*a* to 46*j* are produced.

Next, ceramic green sheets to be the magnetic body layers 47*a* to 47*d* are produced by the following process. Ferric oxide ($Fe_2O_3$), zinc oxide (ZnO), nickel oxide (NiO), and copper oxide (CuO) are weighed at a predetermined amount, the individual materials are put into a ball mill as raw materials, and are subjected to wet mixing. At this time, the zinc oxide (ZnO) content by percentage is lowered than that of the ceramic green sheets to be the magnetic body layers 46*a* to 46*j* at the time of production. The obtained mixture is dried and then crushed. The obtained powder is calcined at 750° C. for one hour. The obtained calcined powder is subjected to wet crushing by a ball mill, and is then dried and disintegrated to obtain ferromagnetic ferrite ceramic powder.

Binder (e.g., vinyl acetate, water-soluble acryl, etc.), plasticizer, humectant, and dispersant are added to the ferrite ceramic powder, subjected to mixing by a ball mill, and then subjected to defoaming by decompression. The obtained ceramic slurry is formed into a sheet state by the doctor blade method, is dried, and ceramic green sheets to be the magnetic body layers 47*a* to 47*d* are produced.

Next, the via-hole conductors B21 to B34 are formed on the ceramic green sheets to be the magnetic body layer 46*c*. Specifically, as shown in FIG. 11, laser beams are irradiated on the ceramic green sheets to be the magnetic body layer 46*c* to form the via-holes. Next, conductive paste, such as Ag, Pd, Cu, Au, and the alloys thereof, etc., is filled in the via-holes by a method, such as printing application.

Also, the via-hole conductors B1 to B14 are formed on the ceramic green sheets to be the magnetic body layers 46*d* to 46*g*. Specifically, as shown in FIG. 11, laser beams are irradiated on the ceramic green sheets to be the magnetic body layers 46*d* to 46*g* to form the via-holes. Next, conductive paste, such as Ag, Pd, Cu, Au, and the alloys thereof, etc., is filled in the via-holes by a method, such as printing application.

Next, conductive paste having Ag, Pd, Cu, Au, and the alloys thereof, etc., as a main component is applied on the ceramic green sheets to be the magnetic body layer 46*c* by a method, such as a screen-printing method, a photo-lithography method, etc., to form the lead-out electrodes 48*a*, 48*b*, and the strip electrodes 50*a* to 50*f*. In this regard, the process of forming the strip electrodes 50*a* to 50*f* and the process of filling the conductive paste into via holes may be carried out by a same process.

Next, conductive paste having Ag, Pd, Cu, Au, and the alloys thereof, etc., as a main component is applied on the ceramic green sheets to be the magnetic body layer 46*h* by a method, such as a screen-printing method, a photo-lithography method, etc., to form the strip electrodes 52*a* to 52*g*.

Next, as shown in FIG. 11, the ceramic green sheets to be the magnetic body layers 47*a*, 47*b*, 46*a* to 46*j*, 47*c*, 47*d* are laminated to be arranged in this order from the upper side to the lower side. More specifically, the ceramic green sheet to be the magnetic body layer 47*d* is disposed. Next, the ceramic green sheet to be the magnetic body layer 47*c* is disposed and tentatively pressure-contacted on the ceramic green sheet to be the magnetic body layer 47*d*. Subsequently, in the same manner, the ceramic green sheets to be the magnetic body layers 46*j*, 46*i*, 46*h*, 46*g*, 46*f*, 46*e*, 46*d*, 46*c*, 46*b*, 46*a*, 47*b*, and 47*a* are laminated in this order, and are pressure-contacted to obtain a mother laminated body. Further, the mother (i.e., bulk) laminated body is subjected to permanent pressure-contacting by hydrostatic pressing.

Next, the mother laminated body is cut into the laminated body 12*d* having a predetermined dimensions by guillotine cut to obtain unfired laminated body 12*d*. This laminated body 12*d* is then subjected to binder burnout processing and firing. The binder burnout processing is performed, for example at 500° C. for two hours in a low oxygen atmosphere. The firing is carried out, for example on the condition of 1000° C. for two hours.

By the above process, the fired laminated body 12*d* is obtained. The laminated body 12*d* is subjected to barrel finishing and chamfering. Subsequently, an electrode paste including silver as a main component is applied and baked on the surface of the laminated body 12*d*, for example by a dipping method, etc., and silver electrodes to be the external electrodes 14*a*, 14*b* are formed. The silver electrodes are dried at 120° C. for 10 minutes, and baking of the silver electrodes is conducted at 890° C. for 60 minutes. Finally, Ni plating/Sn plating is applied on the surface of the silver electrodes so that the external electrodes 14*a*, 14*b* are formed. By going through the above process, the electronic component 10*d* as shown in FIG. 10 is completed.

As shown in FIG. 12, in the electronic component 10*d*, the lamination direction is perpendicular to the coil axis X, and thus it is possible to produce the electronic component 10*d* easily compared with the electronic components 10*a* to 10*c*.

A comparison of the easiness of the production of the electronic component 10*d* and the electronic component 10*a* will now be given.

In more detail, as shown in FIG. 3, in the electronic component 10*a*, the lamination direction (i.e., the z-axis direction) and the coil axis X are parallel. Thus, in order to form the nonmagnetic body layer 22 outside the coil L as shown in FIG. 2, it is necessary to form the nonmagnetic body layers 22 on the magnetic body layers 16 before laminating the magnetic body layers 16 by screen printing, etc.

On the other hand, as shown in FIG. 12, in the electronic component 10*d*, the lamination direction (i.e., the z-axis direction) is perpendicular to the coil axis X. Thus, in order to form the magnetic body layer 47 at the outside of the coil L as shown in FIG. 12, it is sufficient only to laminate the magnetic body layers 47 on the upper side and the lower side of the magnetic body layer 46 in the z-axis direction. Accordingly, it becomes unnecessary to have a process, such as forming the magnetic body layer 47 on the magnetic body layer 46 by screen printing, etc. As a result, the electronic component 10*d* can be produced more easily compared with the electronic components 10*a* to 10*c*.

Figure 13:
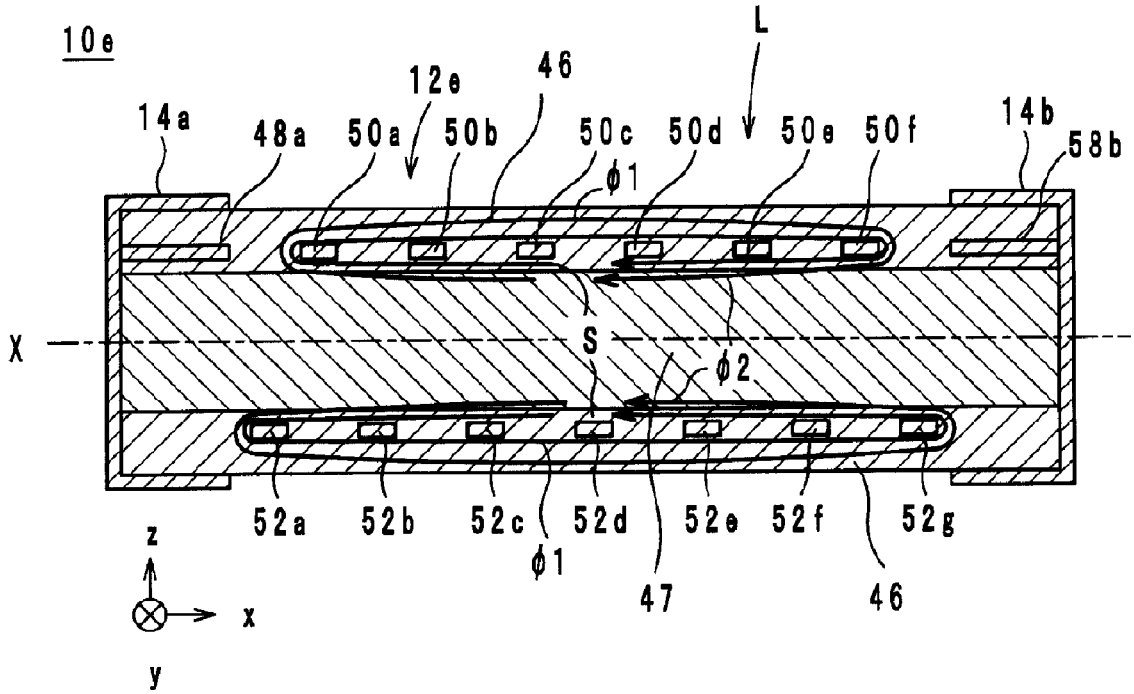
FIG. 13 is a sectional structure view of an electronic component according to a first variation of the electronic component according to the second embodiment.

Description of an electronic component 10*e* according to a first variation of the electronic component 10*d* will now be given. FIG. 13 is a sectional structure view of the electronic component 10*e* according to the first variation. FIG. 10 provides an outer perspective view of the electronic component 10*e* shown in FIG. 13.

As shown in FIG. 12, in the electronic component 10*d*, the magnetic body layer 47 is disposed outside the coil L when seen in a plan view from a direction of the coil-axis X. However, the position where the magnetic body layer 47 is disposed is not limited to this configuration. As shown in FIG. 13, the magnetic body layer 47 may be disposed inside the coil L when seen in a plan view from a direction of the coil-axis X.

More specifically, the magnetic body layer 47 is disposed between the magnetic body layer 46 on which strip electrodes 50*a* to 50*f* are formed and the magnetic body layer 46 on which strip electrodes 52*a* to 52*g* are formed. In the electronic component 10*e* having the above-described configuration, it is possible to obtain a stair-like direct-current superposition characteristic in the same manner as the electronic component 10*a*.

Figure 14:
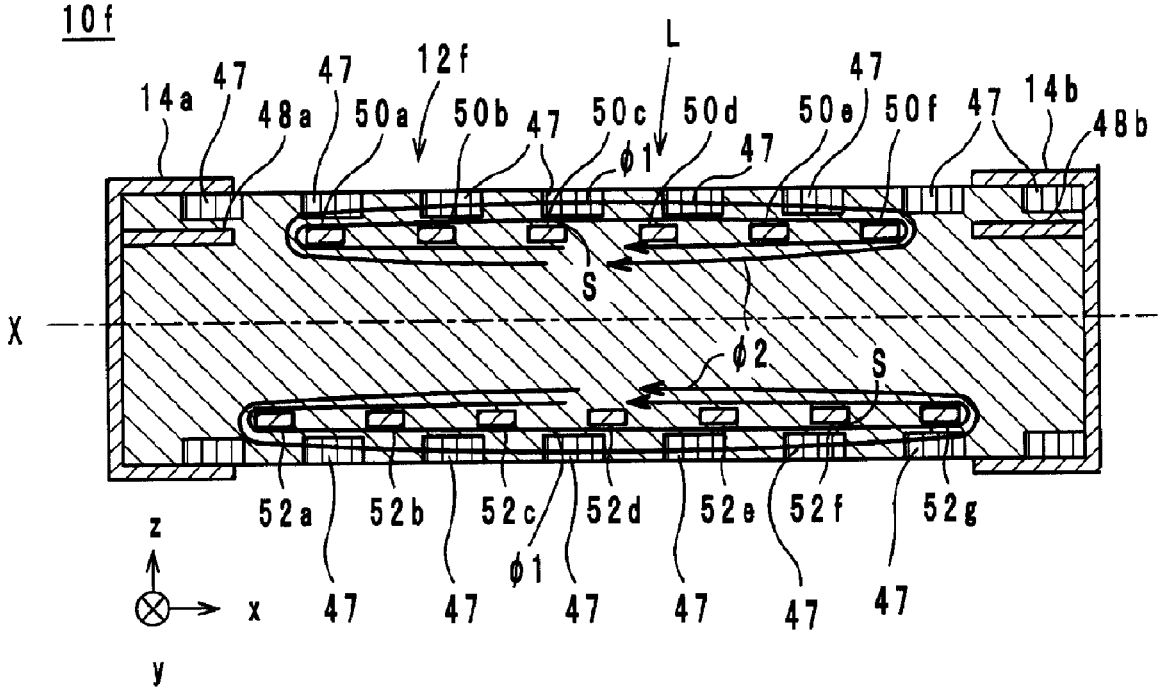
FIG. 14 is a sectional structure view of an electronic component according to a first variation of the electronic component according to the second embodiment.

Description of an electronic component 10*f* according to a second variation of the electronic component 10*d* will now be given. FIG. 14 is a sectional structure view of the electronic component 10*f* according to the second variation. In this regard, for an outer perspective view of the electronic component 10*f*, FIG. 10 is quoted.

As shown in FIG. 11 and FIG. 12, in the electronic component 10*d*, the magnetic body layer 47 and the magnetic body layer 46 have a same shape. However, the shape of the magnetic body layer 47 is not limited to this. For example, as shown in FIG. 14, the magnetic body layer 46 and the magnetic body layer 47 may be arranged alternately in the x-axis direction. In the electronic component 10*f* having the above-described configuration, it is possible to obtain a stair-like direct-current superposition characteristic in the same manner as the electronic component 10*a*.

In this regard, in the electronic component 10*f*, a nonmagnetic body layer may be used in place of the magnetic body layer 47.

The present invention is useful for an electronic component, and in particular, is excellent in the point that a coil having a stair-like direct-current superposition characteristic is included.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An electronic component comprising:

a laminated body formed of a plurality of first insulating layers;

a coil disposed in the laminated body, the coil having a coil axis; and a second insulating layer, said second insulating layer disposed in the laminated body at a predetermined distance from the coil, the distance being viewable as a gap between the second insulating layer and the coil when viewed in a plan view from a coil axis direction of the coil, wherein the second insulating layer has a magnetic permeability lower than that of the first insulating layers, and the second insulating layer is adjacent to one of said plurality of first insulating layers on each side of the second insulating layer in the coil axis direction.

2. The electronic component according to claim 1, wherein the second insulating layer is disposed outside the coil when seen in a plan view from the coil axis direction.

3. The electronic component according to claim 1,
wherein the second insulating layer is disposed inside the coil when seen in a plan view from the coil axis direction.

4. The electronic component according to claim 1,
wherein the coil includes a plurality of coil electrodes laminated together with the plurality of first insulating layers, and
the coil axis direction is parallel to a lamination direction.

5. The electronic component according to claim 2,
wherein the coil includes a plurality of coil electrodes laminated together with the plurality of first insulating layers, and
the coil axis direction is parallel to a lamination direction.

6. The electronic component according to claim 3,
wherein the coil includes a plurality of coil electrodes laminated together with the plurality of first insulating layers, and
the coil axis direction is parallel to a lamination direction.

7. The electronic component according to claim 1,
wherein the gap between the coil and the second insulating layer is not less than 10 μm and not greater than 150 μm.

8. The electronic component according to claim 2,
wherein the gap between the coil and the second insulating layer is not less than 10 μm and not greater than 150 μm.

9. The electronic component according to claim 3,
wherein the gap between the coil and the second insulating layer is not less than 10 μm and not greater than 150 μm.

10. The electronic component according to claim 4,
wherein the gap between the coil and the second insulating layer is not less than 10 μm and not greater than 150 μm.

11. The electronic component according to claim 1,
wherein the coil axis direction is perpendicular to a lamination direction.

12. The electronic component according to claim 2,
wherein the coil axis direction is perpendicular to a lamination direction.

13. The electronic component according to claim 3,
wherein the coil axis direction is perpendicular to a lamination direction.

14. The electronic component according to claim 11,
wherein the coil is a spiral coil including
a plurality of first strip electrodes formed on the first insulating layers disposed on a relatively upper side in the lamination direction,
a plurality of second strip electrodes formed on the first insulating layers disposed on a relatively lower side in the lamination direction, and
a plurality of connection sections extending of the lamination direction of the laminated body, and connecting the first strip electrodes and the second strip electrodes, and
the second insulating layers are disposed on an upper side in the lamination direction of the first insulating layer on which the first strip electrodes are formed, and on a lower side in the lamination direction of the first insulating layer on which the second strip electrodes are formed, respectively.

15. The electronic component according to claim 11,
wherein the coil is a spiral coil including
a plurality of first strip electrodes formed on the first insulating layers disposed on a relatively upper side in the lamination direction,
a plurality of second strip electrodes formed on the first insulating layer disposed on a relatively lower side in the lamination direction, and
a plurality of connection sections extending in the lamination direction of the laminated body, and connecting the first strip electrodes and the second strip electrodes, and
the second insulating layer is disposed between the first insulating layer on which the first strip electrodes are formed, and the first insulating layer on which the second strip electrodes are formed.

16. The electronic component according to claim 15,
wherein the second insulating layers and the first insulating layers are arranged alternately in the coil axis direction.

17. The electronic component according to claim 16,
wherein the second insulating layers are nonmagnetic body layers.

18. The electronic component according to 17,
wherein the gap between the coil and the second insulating layer is not less than 10 μm and not greater than 150 μm.

* * * * *